US011441399B2

(12) United States Patent
Gaudette

(10) Patent No.: US 11,441,399 B2
(45) Date of Patent: Sep. 13, 2022

(54) DOWNHOLE CONFORMABLE SCREEN SYSTEM AND METHOD OF MAKING A CONFORMABLE SCREEN FOR DOWNHOLE USE

(71) Applicant: Sean Gaudette, Katy, TX (US)

(72) Inventor: Sean Gaudette, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/942,131

(22) Filed: Jul. 29, 2020

(65) Prior Publication Data

US 2022/0034203 A1 Feb. 3, 2022

(51) Int. Cl.
*E21B 43/10* (2006.01)
*E21B 43/08* (2006.01)

(52) U.S. Cl.
CPC ..... *E21B 43/108* (2013.01); *E21B 43/082* (2013.01); *E21B 2200/08* (2020.05)

(58) Field of Classification Search
CPC ..... E21B 43/08; E21B 43/82; E21B 43/084; E21B 43/086; E21B 43/088; E21B 43/10; E21B 43/103; E21B 43/108
See application file for complete search history.

(56) References Cited

U.S. PATENT DOCUMENTS 5,611,399 A * 3/1997 Richard ..... B01D 29/15 166/230
10,400,553 B2 * 9/2019 Bruce ..... E21B 33/14
2003/0106688 A1 * 6/2003 Saugier ..... E21B 7/208 175/320
2005/0241824 A1 * 11/2005 Burris, II ..... E21B 23/10 166/255.1
2010/0051262 A1 * 3/2010 Dusterhoft ..... E21B 47/01 166/236
2012/0145389 A1 * 6/2012 Fitzpatrick, Jr. ..... E21B 43/08 166/278
2012/0152528 A1 * 6/2012 Greci ..... E21B 43/088 166/227
2016/0319645 A1 * 11/2016 Mann ..... B01D 29/03
2017/0152731 A1 * 6/2017 Andersen ..... E21B 43/103
2020/0149374 A1 * 5/2020 Narhi ..... E21B 17/00

* cited by examiner

*Primary Examiner* — Abby J Flynn
*Assistant Examiner* — Yanick A Akaragwe
(74) *Attorney, Agent, or Firm* — Cantor Colburn LLP

(57) ABSTRACT

A system of a downhole conformable screen system including a tubular, and a screen defined by a plurality of screen segments positioned radially outward of the tubular, each of the plurality of screen segments being positioned perimetrically between two other of the screen segments, the screen being configured to expand radially to engage with an inner surface of a wellbore after the tubular and screen have been positioned within the wellbore. A method of making a conformable screen for downhole use including forming a plurality of screen segments out of a porous foam, and attaching the plurality of screen segments to a tubular to form a screen around the tubular.

20 Claims, 2 Drawing Sheets

DOWNHOLE CONFORMABLE SCREEN SYSTEM AND METHOD OF MAKING A CONFORMABLE SCREEN FOR DOWNHOLE USE

BACKGROUND

In the resource recovery industry screens are employed downhole to provide radial support to a borehole while allowing hydrocarbons to be produced through the screen filtering out unwanted particulates in the process. While conventional screens serve the purpose for which they were designed, the industry is receptive to new screens and ways of manufacturing screens.

SUMMARY

A system for a downhole conformable screen system including a tubular, and a screen defined by a plurality of screen segments positioned radially outward of the tubular, each of the plurality of screen segments being positioned perimetrically between two other of the screen segments, the screen being configured to expand radially to engage with an inner surface of a wellbore after the tubular and screen have been positioned within the wellbore.

A method of making a conformable screen for downhole use including forming a plurality of screen segments out of a porous foam, and attaching the plurality of screen segments to a tubular to form a screen around the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
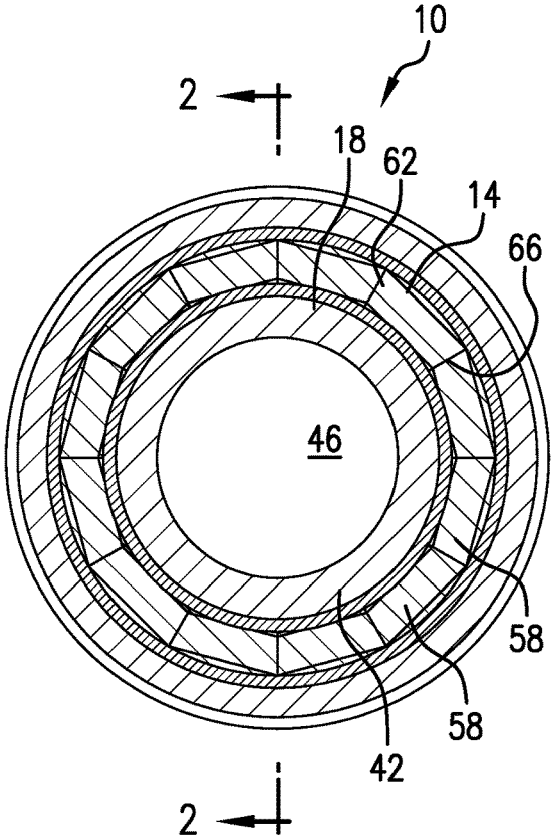
FIG. 1 depicts a cross-sectional view of a downhole conformable screen system disclosed herein taken at arrows 1-1 of FIG. 2.
Figure 2:
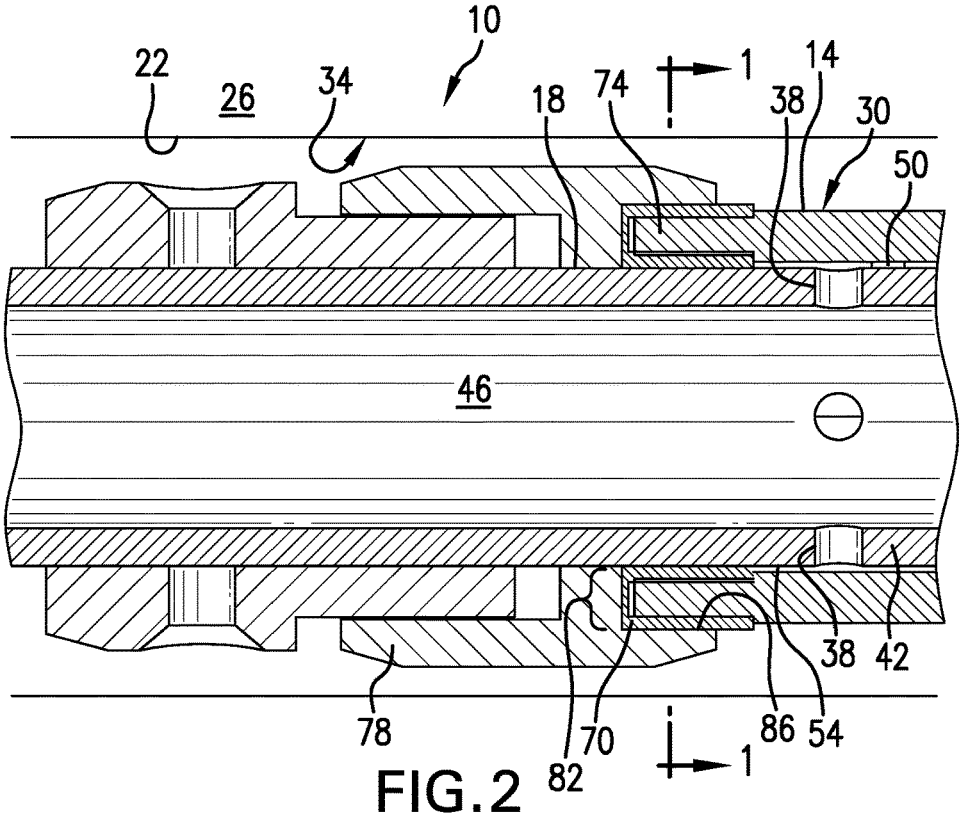
FIG. 2 depicts another cross-sectional view of the downhole conformable screen system of FIG. 1 taken at arrows 2-2 of FIG. 1.

Referring to FIGS. 1 and 2, a downhole conformable screen system 10 disclosed herein is illustrated in two cross-sectional views. The system 10 includes a screen 14 positioned radially outwardly of a tubular 18. The system 10 in FIG. 2 is shown positioned within a wellbore 22 in a formation 26. The screen 14 as illustrated is in the run-in condition. At an appropriate time and after a well operator has the system 10 at a desired location within the wellbore 22, an agent, such as a solvent, may be introduced. The agent is configured to act on the screen 14 with an environment within the wellbore 22 to cause the screen 14 to volumetrically expand. The expansion of the screen 14 causes an outer surface 30 of the screen 14 to engage with an inner surface

34 of the wellbore 22 providing structural support to the wellbore 22. The screen 14 is porous such that fluids, for example hydrocarbons, can flow through the screen 14 while preventing unwanted particulates from flowing through the screen. The screen 14 may be made of a polymer such as a polyurethane porous foam, for example.

Once inside the screen 14, the fluid can flow through a plurality of openings 38 in a wall 42 of the tubular 18 to an inner bore 46 of the tubular 18. Standoffs 50 can be positioned within an annular space 54 between the tubular 18 and the screen 14 to maintain at least a portion of the annular space 54 open for flow of the fluid to the openings 38. The standoffs 50 can be a separate component from the screen 14 and the tubular 18 or can be formed as part of the screen 14 and/or the tubular 18.

The screen 14 is formed by a plurality of screen segments 58 positioned radially outwardly of the tubular 18. Each of the screen segments 58 is positioned perimetrically between two other of the screen segments 58. The screen segments 58 can be attached to the tubular 18. Circumferential compression between adjacent screen segments 58 can seal the segments 58 to one another, in as much as these porous bodies can be considered to be sealed to one another. The screen segments 58 can be molded to a final shape ready for deployment on the system 10 or can be machined to the final shape. In one embodiment, shown in FIG. 1, the screen segments 58 have a trapezoidal cross-sectional shape with a first perimetrical side 62 that is not parallel to a second perimetrical side 66 that is opposite the first perimetrical side 62. As such the first perimetrical side 62 of one screen segment 58 abuts the second perimetrical side 66 of an adjacent screen segment 58.

A retainer 70, best seen in FIG. 2, is shaped and configured to hold longitudinal ends 74 of the screen segments 58 together and to sealingly engage the screen segments 58 with a collar 78 positioned on the tubular 18. The retainer 70 can be metallic, polymeric or an adhesive, and can be partially positioned within an annular gap 82 defined between an undercut 86 of the collar 78 and the tubular 18.

A number of the screen segments 58 employed can be selected to simplify assembly of the screen segments 58 around the tubular 18. The illustrated embodiments employ 12 screen segments 58 such that each segment covers an arc of 30 degrees. Alternate numbers of screen segments 58 are also contemplated.

Figure 3:
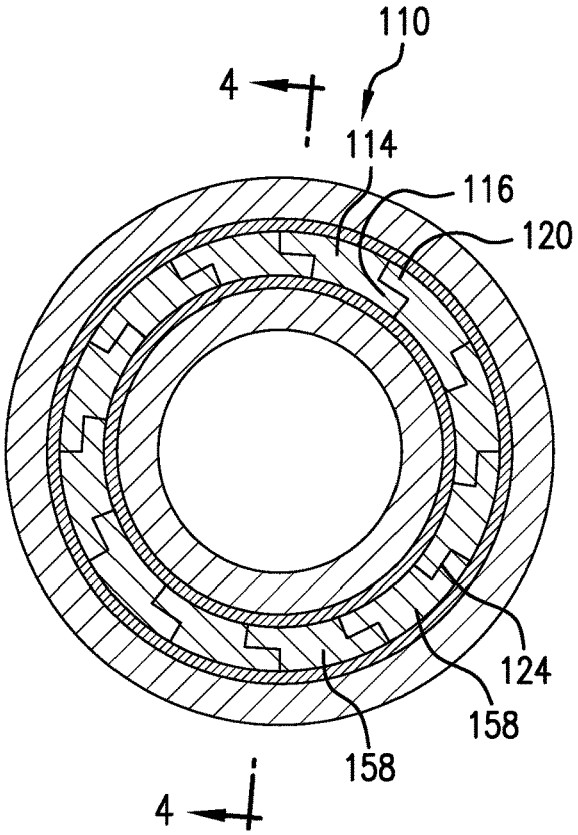
FIG. 3 depicts a cross-sectional view of an alternate embodiment of a downhole conformable screen system disclosed herein taken at arrows 3-3 of FIG. 4.
Figure 4:
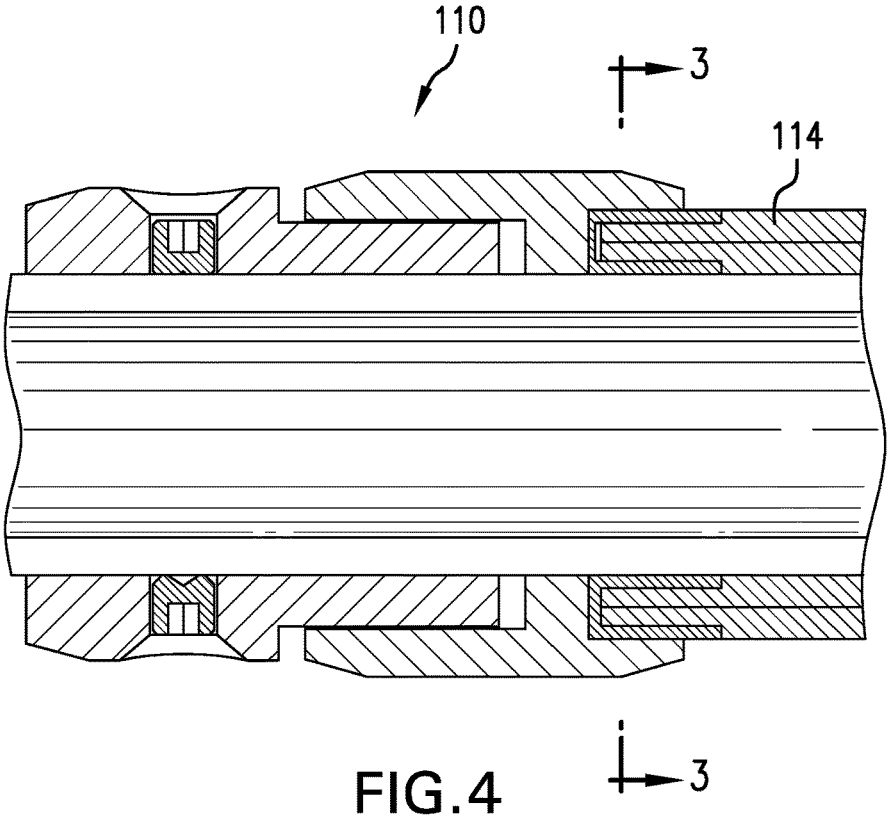
FIG. 4 depicts another cross-sectional view of the downhole conformable screen system of FIG. 3 taken at arrows 4-4 of FIG. 3.

Referring to FIGS. 3 and 4, an alternate embodiment of the downhole conformable screen system 110 is illustrated. The system 110 has similarities to the system 10 and as such like elements are not renumbered in these figures. One primary difference between the system 110 and 10 is based on a cross-sectional shape of screen segments 158 that define screen 114. The screen segments 158 have first longitudinal protrusion 116 on one side and a second longitudinal protrusion 120 on the opposing side. The longitudinal protrusions 116, 120 may extend over a full longitudinal length of the screen segments 158. The first longitudinal protrusions 116 of each of the screen segments 158 is configured to form a lap joint with the second longitudinal protrusions 120 of an adjacent one of the screen segments 158. This lap joint configuration tends to increase radial compression and sealing engagement between adjacent screen segments 158 as the screen segments 158 volumetrically expand. Other joint types include tongue and groove, point and trough, and other styles such as those resembling a venetian blind or the petals of a flower. Regardless of the cross-sectional shape of the screen segments 58, 158, an adhesive 124 may be employed between the adjacent screen segments 58, 158 to help maintain structural integrity of the system 10, 110 during handling and running into the wellbore 22. The adhesive 124 might be configured to degrade or dissolve when exposed to the agent so as not to damage or negatively effect the screen segments 58, 158 as they expand. Alternately, the adhesive 124 may be sufficiently weak to prevent such damage.

Set forth below are some embodiments of the foregoing disclosure:

Embodiment 1

A downhole conformable screen system including a tubular, and a screen defined by a plurality of screen segments positioned radially outward of the tubular, each of the plurality of screen segments being positioned perimetrically between two other of the screen segments, the screen being configured to expand radially to engage with an inner surface of a wellbore after the tubular and screen have been positioned within the wellbore.

Embodiment 2

The downhole conformable screen system as in any prior embodiment, wherein the tubular defines a wall having a plurality of openings that extend radially through the wall, the openings being configured to allow fluid flowing through the screen to flow through the openings into an inner bore of the tubular.

Embodiment 3

The downhole conformable screen system as in any prior embodiment, further comprising a retainer positioned at an axial end of the screen, the retainer being configured to hold the screen segments together.

Embodiment 4

The downhole conformable screen system as in any prior embodiment, wherein the screen segments have trapezoidal cross-sectional shapes configured so that opposing perimetrical sides of the screen segments abut one another.

Embodiment 5

The downhole conformable screen system as in any prior embodiment, wherein a first longitudinal protrusion of one screen segments overlaps a second longitudinal protrusion of another screen segment.

Embodiment 6

The downhole conformable screen system as in any prior embodiment, further comprising an adhesive configured to hold adjacent screen segments to one another.

Embodiment 7

The downhole conformable screen system as in any prior embodiment, wherein the adhesive is configured to degrade when exposed to an agent.

Embodiment 8

The downhole conformable screen system as in any prior embodiment, wherein the adhesive is sufficiently weak so as not to damage the screen segments when they expand.

Embodiment 9

The downhole conformable screen system as in any prior embodiment, further comprising one or more standoffs positioned in an annular space between the tubular and the screen.

Embodiment 10

The downhole conformable screen system as in any prior embodiment, wherein the one or more standoffs are an integral part of the screen segments.

Embodiment 11

The downhole conformable screen system as in any prior embodiment, wherein the plurality of screen segments includes twelve of the screen segments each covering an arc of 30 degrees.

Embodiment 12

A method of making a conformable screen for downhole use including forming a plurality of screen segments out of a porous foam, and attaching the plurality of screen segments to a tubular to form a screen around the tubular.

Embodiment 13

The method of making a conformable screen for downhole use as in any prior embodiment, further comprising positioning one end of the plurality of screen segments in an annular gap defined between the tubular and a collar.

Embodiment 14

The method of making a conformable screen for downhole use as in any prior embodiment, further comprising retaining the plurality of screen segments to the tubular with a retainer.

Embodiment 15

The method of making a conformable screen for downhole use as in any prior embodiment, further comprising adhering each of the plurality of screen segments to perimetrically adjacent ones of the screen segments with adhesive.

Embodiment 16

The method of making a conformable screen for downhole use as in any prior embodiment, further comprising forming a standoff on each of the plurality of screen segments.

Embodiment 17

The method of making a conformable screen for downhole use as in any prior embodiment, further comprising forming the plurality of screen segments so they have a trapezoid cross section.

Embodiment 18

The method of making a conformable screen for downhole use as in any prior embodiment, further comprising forming longitudinal protrusions on opposing perimetrical sides of each of the plurality of screen segments.

Embodiment 19

The method of making a conformable screen for downhole use as in any prior embodiment, further comprising overlapping the longitudinal protrusion of each of the plurality of screen segments with one the longitudinal protrusions of adjacent ones of the plurality of screen segments.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole conformable screen system comprising:

a tubular having a longitudinal axis; and a screen defined by a plurality of longitudinally extending screen segments positioned radially outward of the tubular, each of the plurality of screen segments being positioned perimetrically between two other of the screen segments, the screen being configured to expand radially to engage with an inner surface of a wellbore and have opposing perimetrical sides of each screen segment abutting perimetrical sides of the next adjacent screen segment, such that filtration material of each screen segment abuts filtration material of the next adjacent screen segment both before and after expansion of the screen system.

2. The downhole conformable screen system of claim 1, wherein the tubular defines a wall having a plurality of openings that extend radially through the wall, the openings being configured to allow fluid flowing through the screen to flow through the openings into an inner bore of the tubular.

3. The downhole conformable screen system of claim 1, further comprising a retainer positioned at an axial end of the screen, the retainer being configured to hold the screen segments together.

4. The downhole conformable screen system of claim 1, wherein the screen segments have trapezoidal cross-sectional shapes.

5. The downhole conformable screen system of claim 1, wherein a first longitudinal protrusion that extends in a direction tangential to the tubular longitudinal axis of one screen segments overlaps a second longitudinal protrusion that extends in a direction tangential to the tubular longitudinal axis of another screen segment.

6. The downhole conformable screen system of claim 1, further comprising an adhesive configured to hold adjacent screen segments to one another.

7. The downhole conformable screen system of claim 6, wherein the adhesive is configured to degrade when exposed to an agent.

8. The downhole conformable screen system of claim 6, wherein the adhesive is sufficiently weak so as not to damage the screen segments when they expand.

9. The downhole conformable screen system of claim 1, further comprising one or more standoffs positioned in an annular space between the tubular and the screen.

10. The downhole conformable screen system of claim 9, wherein the one or more standoffs are an integral part of the screen segments.

11. The downhole conformable screen system of claim 1, wherein the plurality of screen segments includes twelve of the screen segments each covering an arc of 30 degrees.

12. A method of making a conformable screen for downhole use comprising:

forming a plurality of screen segments out of a porous foam, each segment having perimetrical sides; and attaching the plurality of screen segments to a tubular to form a screen around the tubular, wherein perimetrical sides of each screen segment remains in contact with a perimetrical side segment of a next adjacent screen segment both before and after expansion of the screen.

13. The method of making a conformable screen for downhole use of claim 12, further comprising positioning one end of the plurality of screen segments in an annular gap defined between the tubular and a collar.

14. The method of making a conformable screen for downhole use of claim 12, further comprising retaining the plurality of screen segments to the tubular with a retainer.

15. The method of making a conformable screen for downhole use of claim 12, further comprising adhering each of the plurality of screen segments to perimetrically adjacent ones of the screen segments with adhesive.

16. The method of making a conformable screen for downhole use of claim 12, further comprising forming a standoff on each of the plurality of screen segments.

17. The method of making a conformable screen for downhole use of claim 12, further comprising forming the plurality of screen segments so they have a trapezoid cross section.

18. The method of making a conformable screen for downhole use of claim 12, further comprising forming longitudinal protrusions on opposing perimetrical sides of each of the plurality of screen segments.

19. The method of making a conformable screen for downhole use of claim 18, further comprising overlapping the longitudinal protrusion of each of the plurality of screen segments with one the longitudinal protrusions of adjacent ones of the plurality of screen segments.

20. A downhole conformable screen system comprising:

a tubular having a longitudinal axis; and a screen defined by a plurality of longitudinally extending foam screen segments positioned radially outward of the tubular, each of the plurality of screen segments being positioned perimetrically between two other of the screen segments, the screen being configured to expand radially to engage with an inner surface of a wellbore and have opposing perimetrical sides of each screen segment abutting perimetrical sides of the next adjacent screen segment, such that foam material of each screen segment abuts the foam material of the next adjacent screen segment both before and after expansion of the screen system.

* * * * *